US006428336B1

(12) United States Patent
Akerfeldt

(10) Patent No.: US 6,428,336 B1
(45) Date of Patent: Aug. 6, 2002

(54) FEMALE CONNECTOR

(75) Inventor: Dan Akerfeldt, Uppsala (SE)

(73) Assignee: Radi Medical Systems AB, Uppsala (SE)

( * ) Notice: Subject to any disclaimer, the term of this patent is extended or adjusted under 35 U.S.C. 154(b) by 0 days.

(21) Appl. No.: 09/405,129

(22) Filed: Sep. 24, 1999

Related U.S. Application Data

(63) Continuation of application No. PCT/EP98/00542, filed on Mar. 25, 1998.
(60) Provisional application No. 60/042,394, filed on Mar. 25, 1997.

(30) Foreign Application Priority Data

Mar. 25, 1997 (SE) ..... 9701108

(51) Int. Cl.[7] ..... H01R 13/15
(52) U.S. Cl. ..... 439/263; 439/268; 439/909; 439/805
(58) Field of Search ..... 439/266, 267, 439/668, 669, 67, 77, 263, 268, 805, 839, 909, 729, 893; 600/585, 506

(56) References Cited

U.S. PATENT DOCUMENTS

| | | | | | |
|---|---|---|---|---|---|
| 5,088,942 | A | * | 2/1992 | Welsh et al. | 439/843 |
| 5,240,437 | A | * | 8/1993 | Christian | 439/668 |
| 5,358,409 | A | * | 10/1994 | Obara | 439/20 |
| 5,486,123 | A | * | 1/1996 | Miyazaki | 439/825 |
| 5,730,628 | A | * | 3/1998 | Hawkins | 439/843 |
| 5,938,624 | A | * | 8/1999 | Akerfeldt et al. | 600/585 |
| 6,039,614 | A | * | 3/2000 | Ramari | 439/843 |
| 6,042,432 | A | * | 3/2000 | Hashizawa et al. | 439/843 |

* cited by examiner

*Primary Examiner*—Tho D. Ta
*Assistant Examiner*—Phuongchi Nguyen
(74) *Attorney, Agent, or Firm*—Foley & Lardner

(57) ABSTRACT

The invention relates to a miniaturized female connector (200) for a guide wire assembly. The female connector has a proximal end and a distal end and has a hollow insulating housing (202) capable of being attached to an interface cable (208). It also has an opening (203) for insertion of a male connector, provided on a guide wire, in the distal end. There is at least one contact member (204*a–c*) providing electrical contact with the male connector. The female connector can be secured to the male connector to prevent any axial or rotational motion of the male connector relative to the female connector.

13 Claims, 5 Drawing Sheets

FEMALE CONNECTOR

The Applicant hereby claims the benefit of PCT application PCT/SE98/00542, filed Mar. 25, 1998 (and which designated the United States and was published as WO 98/43318), and U.S. Provisional Application No. 60/042, 394, filed Mar. 25, 1997. The present application is a continuation of the above-noted PCT application and a continuation-in-part of the U.S. provisional application. The entire contents of this PCT application, the U.S. Provisional application and Swedish application 9701108-4 (filed Mar. 25, 1997) are incorporated herein by reference.

The present invention relates to a female connector for a guide wire assembly, said guide wire assembly comprising a guide wire having a male connector and an interface cable, and more particularly to a female connector preventing any rotation of the guide wire assembly in relation to said interface cable.

BACKGROUND OF THE INVENTION

In intravascular imaging one uses guide wire assemblies comprising a guide wire with a sensor mounted at its distal tip, and an interface cable, connecting to external equipment such as monitors, control units, computers etc. The guide wire is introduced into the vascular tree, and by rotating said guide wire while passing it forward into the vessel it can be properly located at a desired vessel site. Conductors extending along the guide wire transmit signals from the sensor, and are connected by a suitable connector to means for processing the electrical signals via an interface cable.

The guide wire assembly must allow for rotational motion of the guide wire, since otherwise the physician performing the insertion of the guide wire would have to control connector and guide wire separately.

In accordance with the teachings of U.S. Pat. No. 5,178, 159 this is accomplished with a connector assembly permitting rotation of the male connector with respect to the female connector. However, a considerable disadvantage of this embodiment is that the transmission of signals through the connector is distorted when the guide wire is rotated. Furthermore the structure of tho device according to this patent is fairly complex, in that it comprises many moving parts on a miniature scale.

SUMMARY OF THE INVENTION

The object of the invention is thus to eliminate the problem of the prior art connector. In accordance with the present invention there is provided a female connector having means for securing a guide wire, having a mating male connector, within said female connector, such that the entire connector has the capability to rotate with the wire, without the physician considering this troublesome.

Preferably the female connector is adapted to receive a male connector having essentially uniform diameter along the whole length thereof. Suitably the proximal end of said female connector is connected to an interface cable, connecting to an external control unit.

BRIEF DESCRIPTION OF THE DRAWINGS

The invention will be described in detail below with reference to the drawings, in which.

DETAILED DESCRIPTION OF PREFERRED EMBODIMENTS

Figure 1:
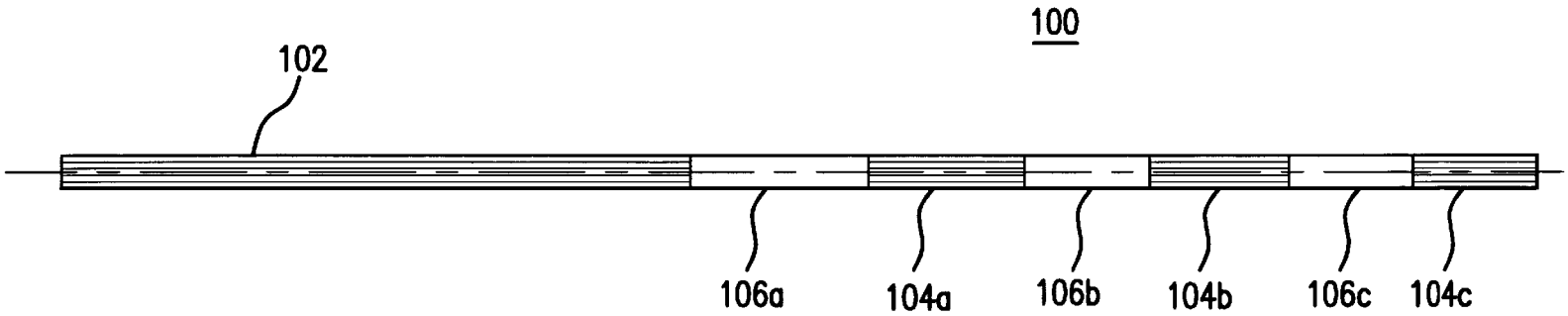
FIG. 1 shows a proximal section of a guide wire, provided with a male connector.

In FIG. 1, a male connector 100 is depicted. It is located on the proximal end of a guide wire 102, the guide wire and the connector having essentially the same diameter. Male connector 100 is comprised of three conductive cylindrically shaped members 104*a, b* and *c,* one for each conductor required in the guide wire 102, separated by means of insulating spacing means 106*a, b* and *c*. On insertion of the male connector in the female connector conductive cylindrically shaped member is brought into contact with the corresponding female contact member. A guide wire having a suitable male connector is disclosed in our applications Ser. No. 09/047,456 (filed Mar. 25, 1998) and Ser. No. 08/927,677. (filed Sep. 10, 1997).

Figure 2:
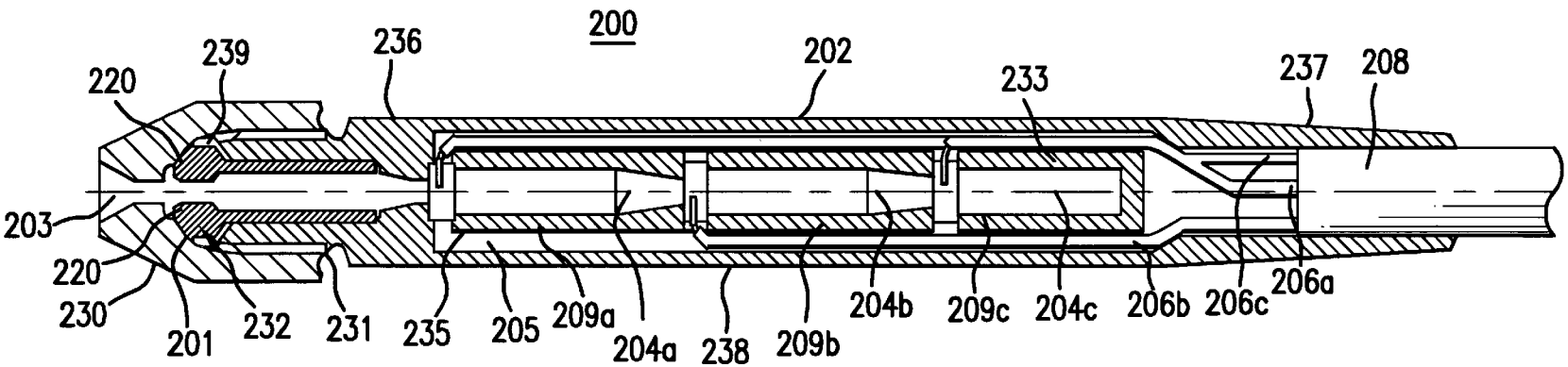
FIG. 2 shows a cross section of a female connector according to the present invention, having three contact members.

FIG. 2 a female connector 200 of the present invention is illustrated in partial cross section. It has a distal end and a proximal end, the former adapted to receive the male connector. The female connector comprises an insulating hollow housing 202 having a distal portion 236, a proximal portion 237, and an intermediate portion 238 containing three hollow, contact members 209*a, b* and *c,* the details of which will be described below. At the distal end of tho female connector, means 230 and 232 for securing the male connector in said female connector are provided. In the proximal portion of the insulating housing 202, an opening in provided which is adapted to receive an interface cable 208, having a number of conductors 206.

The exterior surface 231 of the distal portion is threaded in order to receive a clamping nut 230. The clamping nut has a wide first end, having an inner diameter matching the outer diameter of said distal portion of the housing, the inner surface of which being provided with rounds of threads. The opposite end of the clamping nut has a receiving opening with a smaller diameter, allowing insertion of the male connector. This receiving opening, has an essentially conically shaped entrance opening 203 assisting the insertion of the male connector. Further, said nut has a conically shaped bottom 239, in order to engage with a corresponding tapered or conical surface 201 of a clamping device 232, when threaded onto the distal portion. The clamping device 232 is inserted in the distal portion of the housing. Said clamping device comprises a tube having in one end thereof four slots in the axial direction, forming four resilient tongues 220 having spring characteristics, extending from a circular circumference at the other end of said tube. The free ends of said resilient tongues form said conical outer surface 201 adapted to engage with the corresponding bottom surface 239 in said clamping nut 230. Furthermore, said clamping device 232 is adapted to engage with the outer surface of a male connector inserted in the female connector, when acted upon by the nut 230. Thus, when threaded onto said proximal portion of the housing, the nut accomplishes a clamping action of the clamping device. Thereby any axial or rotational motion of the male connector inside the female connector will be prevented.

Figure 7:
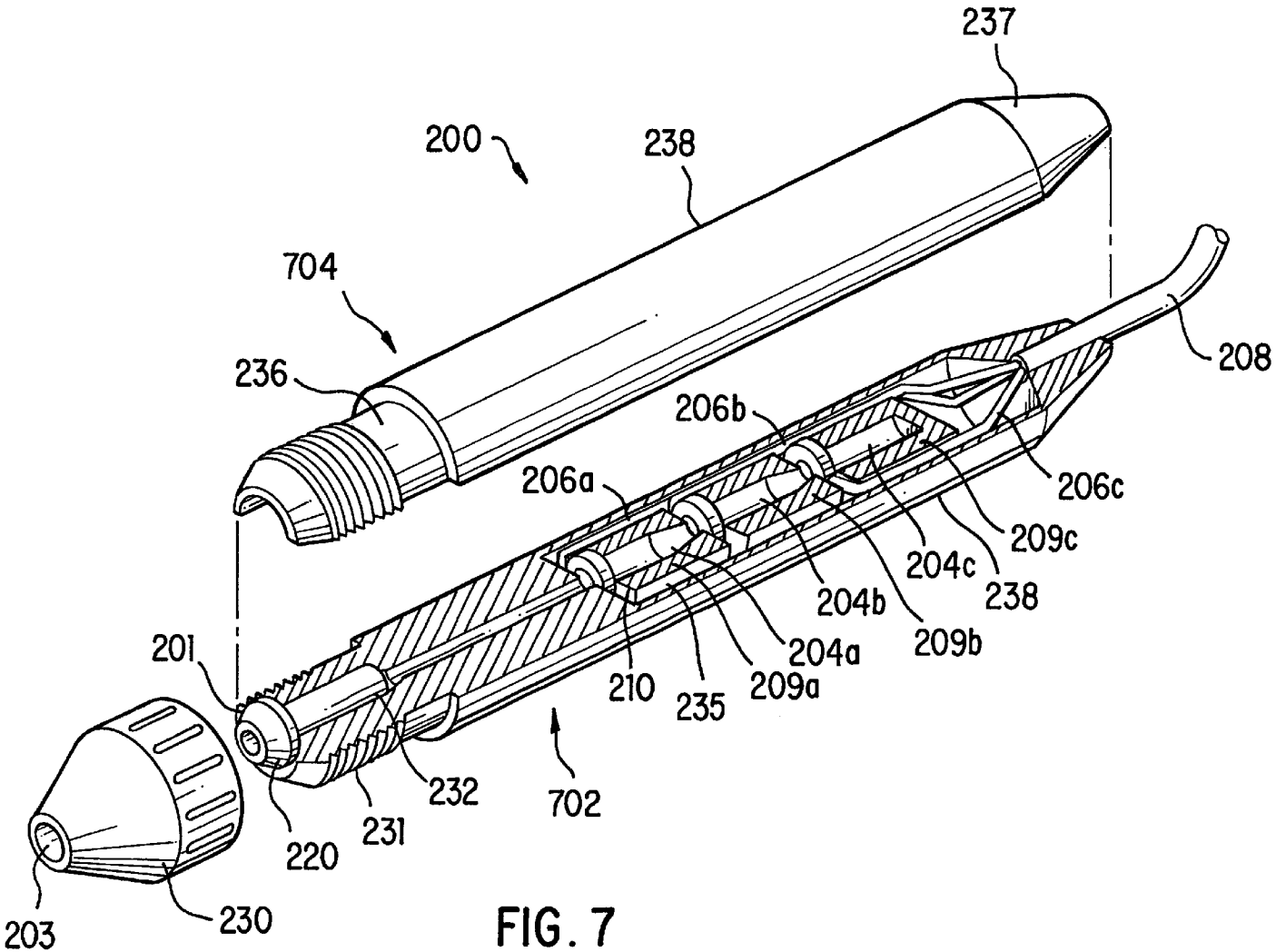
FIG. 7 is a perspective view of the female connector.

With reference to FIG. 7, which more clearly illustrates the interior of the connector of the invention, the design of the contact structure of the connector will be described.

Thus, in the intermediate portion 238 of the connector, contact seats 209*a–c,* extending axially along the portion are provided, separated from each other. Each contact seat is formed between two walls and adapted to hold one of the contact members 204, and is thus formed with a recess 210 having a shape and dimensions exactly corresponding to the shape and dimension of a contact member 204, i.e. the recess in each seat is hemi-cylindrical.

The most proximal contact seat is confined by a single U-shaped wall 233 (see FIG. 2). The wall 235 of said insulating housing and the walls of the contact seats in the contact portion define a space 205 where the conductors 206 from the interface cable can be located so as to reach each contact member.

The three hollow contact members 204 are disposed one in each of the contact seats in the insulating housing at a distance axially from each other. Preferably, the contact member located at the proximal end 204*c* has a closed bottom.

The number of contact members (in this case threw) is chosen according to the required number of conductors, 206*a, b* and *c,* in the interface cable 208 The conductors 206 from the interface cable 208, entering said housing at the proximal portion 237, are provided in said space between the wall 235 of the housing and the walls 233 and 235 as desired. Said conductors have a length sufficient to reach the respective contact member 204.

Figure 3:
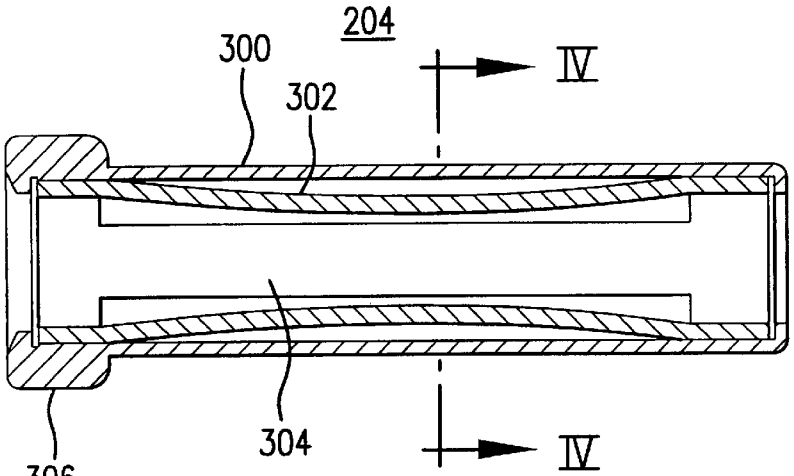
FIG. 3 illustrates a contact member.

FIG. 3 illustrates a contact member 204 comprising an outer contact cylinder 300 and an inner cylinder 302. Preferably, contact cylinder 300 has at the distal end thereof, a wider portion 306, onto which one or more interface cable conductors can be soldered in order to accomplish electrical contact therebetween. Of course, said electrical contact can be achieved by any suitable means such as contact screws or clamping devices or the like. Preferably, in the case of the most proximal contact member 204*c* in the insulating housing 202, the bottom of said contact cylinder 300 is closed. The inner cylinder, which is locked inside the outer one by any suitable means, for example by simple friction fit, has four resilient bear shaped members 304 curved inwards, towards the center of said cylinder, extending along the body of said inner cylinder, for engaging with the corresponding male conductive cylindrically shaped member 104, securing electrical contact thereof. An advantage of providing much beams as resilient clamping means for holding the male connector and thereby the guide wire in a central position, is the relative ease of manufacture. Said beams are simply made by providing longitudinally extending parallel cuts in a suitable piece of a tube, and then deforming the narrow strip between the cuts, by pressing it slightly inwards.

Figure 4:
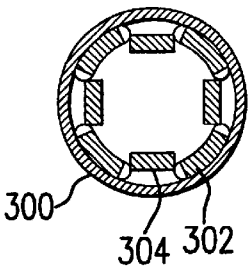
FIG. 4 shows a cross section of the contact member in FIG. 3.

In FIG. 4, a cross section along the line IV—IV in FIG. 3 of the contact member 204 in FIG. 3 is shown, with the four beam shaped members 304 defining the inner diameter thereof.

Figure 5:
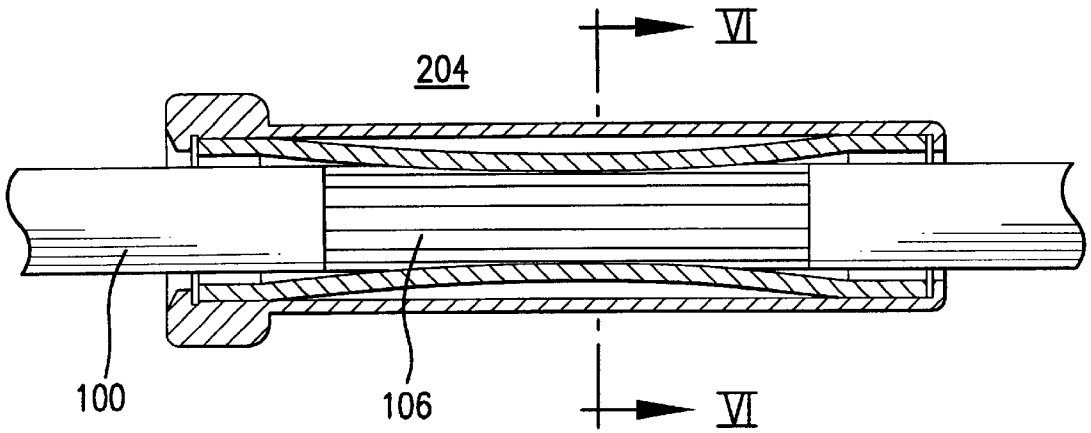
FIG. 5 shows a contact member, having inserted therein a male connector.

In FIG. 5, a contact member 204 is shown having inserted therein a conductive cylindrically shaped member 104 of a male connector 100.

Figure 6:
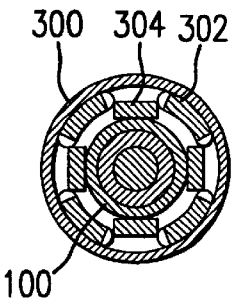
FIG. 6 shows cross section of a the contact member with a male connector according to FIG. 5.

FIG 6 illustrates a cross section along the line VI—VI in FIG. 5, where a conductive member 104 of the male connector can be seen inserted in said contact member.

FIG. 7 is a perspective of the female connector shown 200 in FIG. 2 showing the clamping nut 230 and two essentially similar halves 702 and 704 forming the insulating housing when assembled. The lower part 702 is shown with the three contact members 204*a–c* placed in respective seats 209*a–c,* and having leads 206*a–c* attached to them.

While this embodiment of the invention has been described with reference to a female connector having three contact members, it is to be understood that the number thereof is not critical. Also, said number must not necessarily be the same as the number of conductors in the interface cable, and can thus be higher or lower as appropriate. Likewise, the number of beam shaped members 304 in the contact member 204 can be any suitable number as long as a good continuous electrical contact is secured, and said number can also be different in different contact members in the same female connector.

Another embodiment of the invention will now be described with reference to FIGS. 8–11.

Figure 8:
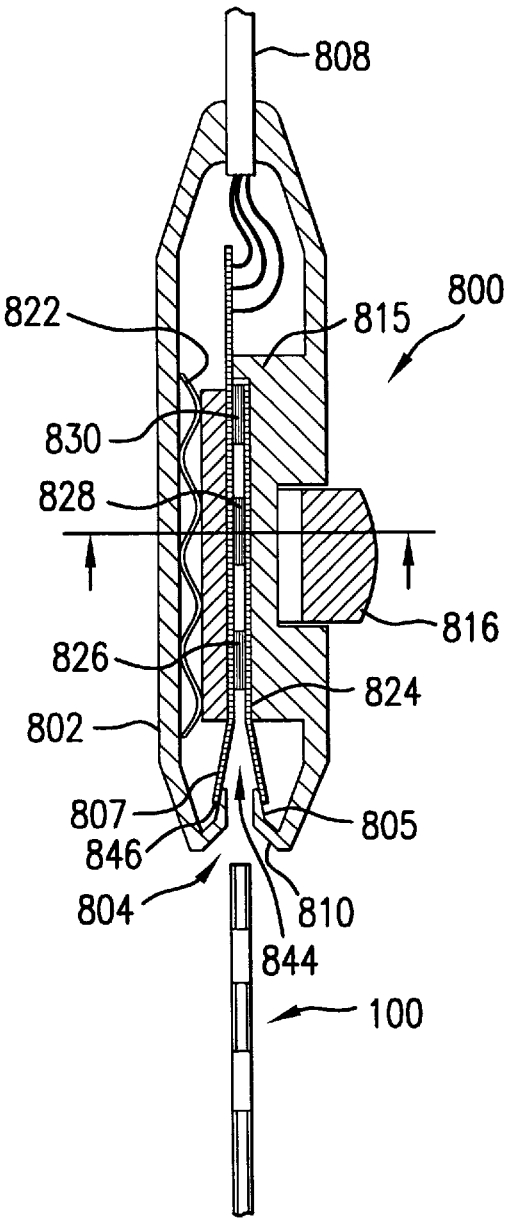
FIGS. 8–11 illustrate another embodiment.
Figure 9:
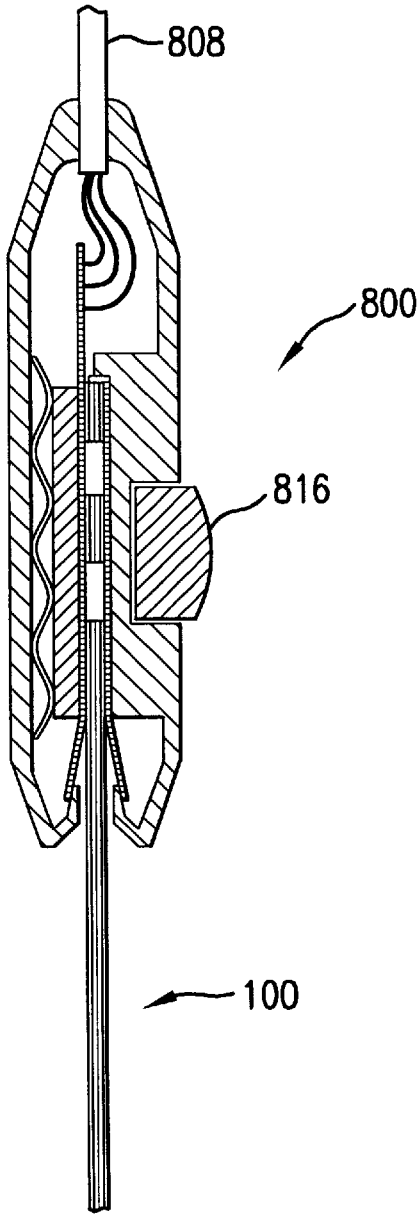

In FIG. 8 there is disclosed a female connector according to the invention in cross section, and in a state where a male connector is disconnected. In FIG. 9 the male connector has been inserted and is clamped inside the connector.

The connector, generally designated 800 in FIG. 8, comprises a first part and a second part resiliently coupled to each other by a spring means, such that the respective portions thereof press against each other, exerting a clamping force (to be described below). Said first part is an essentially tube shaped housing, having a proximal end with an opening 804 for receiving a male connector 805, and a distal end where an interface cable 808 is connected. In the shown embodiment the interface cable is inserted through a hole and electrically connected inside the housing 802 However, it is conceivable to attach the interface cable by other means, such as soldering to exterior contact members provided on the housing (not shown).

The opening 804 is tapered 810 in order to facilitate insertion of the male connector.

Figure 10:
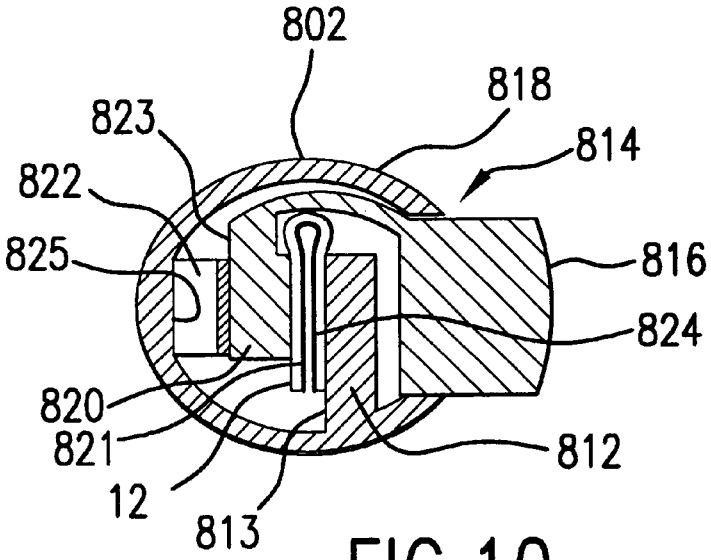
Figure 11:
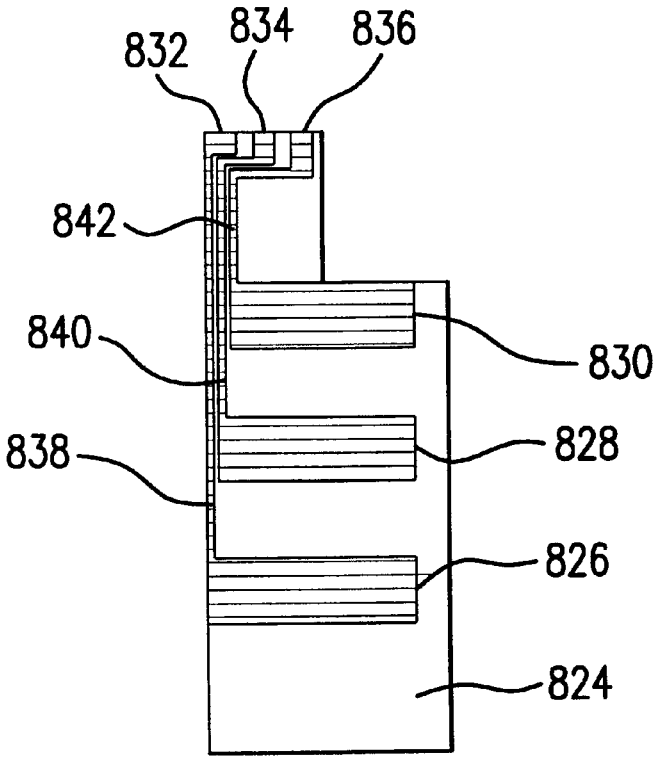

Reference is now made to FIG. 10. Inside the housing there is provided a support ledge 812 extending inwards from the inner surface of said housing 802, slightly displaced from a strict radial direction. This ledge, which has a flat surface 813, acts as an abutment for the clamping function to be described below.

An opening 814 in the side wall of the housing 802 is provided, through which a release button 816 extends such as to be accessible for pressing by e.g. the thumb of an operator The button 816 is connected via a beam member 818 to an actuating element 820, having a flat pressing surface 821 and a back surface 823, said pressing surface being adapted to rest against said flat surface 813 of said support ledge 812. The button, beam and actuating element form said second part. Said actuating element 820 presses against said surface 813 under bias from a spring member 822 located inside the housing, between the inner wall of the housing 802 and the back surface 823 of said actuating element 820. The spring may have any suitable configuration, but in the shown embodiment it is made of a type of corrugated or folded sheet metal, providing the required resilience. For facilitating mounting and more reliable function, the inner surface of the housing 802 may have a flat resting surface 825 on which the spring rests.

Between the actuating element 820 and the support ledge 812, there is provided a sheet 824 of thin, flexible material, folded on itself. This sheet (see FIG. 11) has at least one portion, preferably two or three portions, provided with thin layers of conductive material, in the form of strips 826, 628, 830, extending across the sheet 824, corresponding to the transverse direction of the connector. These portions form contact members for contacting the corresponding contact members on a male connector to be inserted in the female connector Each contact member 826, 828, 830 is connected to proximal contact pads 832, 834, 836 via narrow conductive strips 838, 840, 842. Thus, when the sheet 824 is folded over on itself, and located in the housing, between the actuating element 820 and the support ledge 812, each contact strip will form a double contact, allowing a male connector to be electrically engaged from two sides.

Preferably the sheet is attached to the flat surfaces 813, 821, of the actuating element 820 and the support ledge 812, respectively, by some suitable means, such as gluing. This is however not mandatory. The sheet may simply be placed between the respective surfaces 813 and 821, and by virtue of the flexible material having a certain degree of resilience, it will spring open to a sufficient extent when the release button 816 is pressed.

The support ledge 812 is provided at its proximal end with an end stop 915 to restrict the depth to which the male connector may be inserted This will guarantee that proper alignment of the contact members on said male connector and on the sheet, respectively, will be achieved.

In order to facilitate insertion of the male connector, and preventing interfering of the edges 846 of said sheet, the opening 804 may be formed with inward extensions 805 in the proximal direction, providing supports for said edges 846. Thus, the edges may be located such that they rest against said extensions 805 from the inside, thereby forming a funnel like configuration 807.

The connector is operated as follows:

In its initial condition, the spring 822 presses against the actuating element, thereby clamping the sheet 624 between raid flat surfaces 813, 821. By pressing the release button 916, the force being transferred via said beam member to said actuating member, the spring 822 will be compressed and a recess 844 will form between the actuating element and the support ledge. Then the male connector may be inserted into the female connector until the end abuts the end stop 815 The force on the release button 816 is removed, and the spring 822 causes the recess to close again, thereby clamping the male connector in place.

In a variation of the embodiment of FIG 8, the spring 822 may be replaced by an excentric rod. The center of rotation is thus displaced from the middle point of the circular cross section. The rod is mounted in the housing such that the axis of rotation is fixed. A lever or knob for rotating said rod may extend from the housing, and when the lever or knob is actuated, the actuating element 820 will be displaced, thus opening or closing the recess 844.

Another conceivable option is to provide a rod having an elliptic cross section. Such a rod need not be physically mounted to the housing but may simply be placed inside replacing the spring.

Other means for causing the displacement of the actuating element 820 are possible and are conceived to be within the scope of the inventive concept, and the skilled man could design variations without departing from the scope of the invention.

What is claimed is:

1. A female connector for a guide wire assembly, for coupling a male connector provided on a guide wire to an interface cable, said female connector comprising:

clamping means for clamping said male connector in said female connector, such that any axial or rotational motion of said male connector relative to said female connector is prevented;

wherein said clamping means comprises a hollow insulating housing provided with means at the proximal end thereof for connecting said interface cable to said housing, and an opening at the distal end for insertion of said male connector therein, means for clamping the male connector comprising a clamping nut adapted to be threaded onto a correspondingly threaded exterior surface of a distal portion of said housing, and a clamping device inserted in the distal portion of said housing, adapted to engage with the outer surface of said male connector when inserted in the female connector, when said clamping nut acts on said clamping device, when said clamping nut is tightened; and wherein said clamping device comprises a tube having in one end thereof slots in the axial direction, forming resilient tongues having spring characteristics, extending from a circular circumference at the other end of said tube.

2. The female connector as claimed in claim 1, wherein said clamping nut is provided with an essentially conically shaped entrance opening assisting the insertion of the male connector.

3. An interface cable for connecting a guide wire, provided with an electric measurement device, to external signal processing equipment, said guide wire having a male connector at its proximal end, said interface cable comprising a female connector according to claim 1.

4. The female connector as claimed in claim 1, wherein free ends of said resilient tongues form a conical outer surface adapted to engage with a corresponding conical surface in said nut.

5. The female connector as claimed in claim 4, wherein said clamping device is provided with at least three resilient tongues.

6. The female connector as claimed in claim 1, further comprising at least one contact member arranged in said housing for providing electrical contact with said male connector; and connecting means provided in said proximal end connected with said contact member, and connectable to the interface cable.

7. The female connector as claimed in claim 6, wherein said at least one contact member comprises a contact cylinder.

8. The female connector as claimed in claim 1, further comprising at least one contact member with an inner cylinder having resilient beam shaped members curved inwards, towards the center of said cylinder, extending along the body of said inner cylinder, said inner cylinder being inserted in an outer cylinder.

9. The female connector as claimed in claim 8, wherein said inner cylinder is provided with at least three resilient beam shaped members.

10. The female connector as claimed in claim 9, wherein said inner cylinder is frictionally locked inside the outer cylinder.

11. A female connector for a guide wire assembly, for coupling a male connector provided on a guide wire to an interface cable, said female connector comprising clamping means for clamping said male connector in said female connector, such that any axial or rotational motion of said male connector relative to said female connector is prevented;

wherein said clamping means comprises a hollow insulating housing provided with means at the proximal end thereof for connecting said interface cable to said housing, and an opening at the distal end for insertion of said male connector therein, means for clamping the male connector comprising a clamping nut adapted to be threaded onto a correspondingly threaded exterior surface of a distal portion of said housing, and a clamping device inserted in the distal portion of said housing, adapted to engage with the outer surface of said male connector when inserted in the female connector, when said clamping nut acts on said clamping device, when said clamping nut is tightened; and wherein said female connector has three contact members.

12. The female connector as claimed in claim 11, wherein one of the three contact members is provided with a portion for soldering one or more conductors of an interface cable thereon.

13. The female connector as claimed in claim 11, wherein one of three contact members has a closed bottom.

* * * * *